US009851662B2

(12) United States Patent
Sasami

(10) Patent No.: US 9,851,662 B2
(45) Date of Patent: Dec. 26, 2017

(54) IMAGE FORMING SYSTEM FOR REDUCING WASTE PAPER

(71) Applicant: KONICA MINOLTA, INC., Chiyoda-ku, Tokyo (JP)

(72) Inventor: Shingo Sasami, Tokyo (JP)

(73) Assignee: KONICA MINOLTA, INC., Chiyoda-ku, Tokyo (JP)

( * ) Notice: Subject to any disclaimer, the term of this patent is extended or adjusted under 35 U.S.C. 154(b) by 0 days.

(21) Appl. No.: 15/237,014

(22) Filed: Aug. 15, 2016

(65) Prior Publication Data

US 2017/0060048 A1 Mar. 2, 2017

(30) Foreign Application Priority Data

Sep. 2, 2015 (JP) ..... 2015-172438

(51) Int. Cl.
*G03G 15/00* (2006.01)
*G03G 15/20* (2006.01)

(52) U.S. Cl.
CPC ..... *G03G 15/2028* (2013.01); *G03G 15/652* (2013.01); *B65H 2301/30* (2013.01);
(Continued)

(58) Field of Classification Search
CPC ..... G03G 15/652; G03G 15/2028
See application file for complete search history.

(56) References Cited

U.S. PATENT DOCUMENTS 5,432,593 A * 7/1995 Nishikawa ..... G03G 15/2064 399/328
6,385,432 B1 5/2002 Hanazato et al.
(Continued)

FOREIGN PATENT DOCUMENTS

JP H06286272 A 10/1994
JP 2005024577 A 5/2005
(Continued)

OTHER PUBLICATIONS

Extended European Search Report dated Jan. 4, 2017, issued by the European Patent Office in corresponding European Application No. 16183482.5. (10 pages).
(Continued)

*Primary Examiner* — G. M. Hyder
(74) *Attorney, Agent, or Firm* — Buchanan Ingersoll & Rooney PC

(57) ABSTRACT

An image forming system includes a sheet conveyance unit, an image forming unit, a fixing unit and a controller. The sheet conveyance unit conveys continuous paper. The image forming unit forms an image on the continuous paper. The fixing unit fixes the image formed on the continuous paper. The controller controls an image forming operation performed by the sheet conveyance unit, the image forming unit and the fixing unit. In a case where a waste paper reduction mode is selected, the controller controls the sheet conveyance unit to stop conveying the continuous paper so that a bottom end of a last image on the continuous paper be at a second stop position on an upper-stream side of a first stop position after the bottom end of the last image passes the fixing unit when ending the image forming operation.

18 Claims, 5 Drawing Sheets

(52) U.S. Cl.
CPC ..... *G03G 15/6573* (2013.01); *G03G 2215/00455* (2013.01); *G03G 2215/00599* (2013.01); *G03G 2215/00814* (2013.01)

(56) References Cited

U.S. PATENT DOCUMENTS

| | | | | |
|---|---|---|---|---|
| 2015/0078771 | A1* | 3/2015 | Tanigami | G03G 15/6529 399/45 |
| 2015/0168902 | A1* | 6/2015 | Sasami | G03G 15/5054 399/72 |
| 2015/0268600 | A1* | 9/2015 | Umeno | G03G 15/2064 399/67 |
| 2016/0078331 | A1* | 3/2016 | Ikeda | B41J 15/00 358/1.14 |
| 2016/0236889 | A1* | 8/2016 | Nakamura | G03G 15/55 |

FOREIGN PATENT DOCUMENTS

| | | | |
|---|---|---|---|
| JP | 2008-114564 | A | 5/2008 |
| JP | 2014170195 | A | 9/2014 |

OTHER PUBLICATIONS

Japanese Office Action issued by the Japanese Patent Office dated Jul. 11, 2017 in corresponding Japanese Patent Application No. 2015-172438 with full English translation.

* cited by examiner

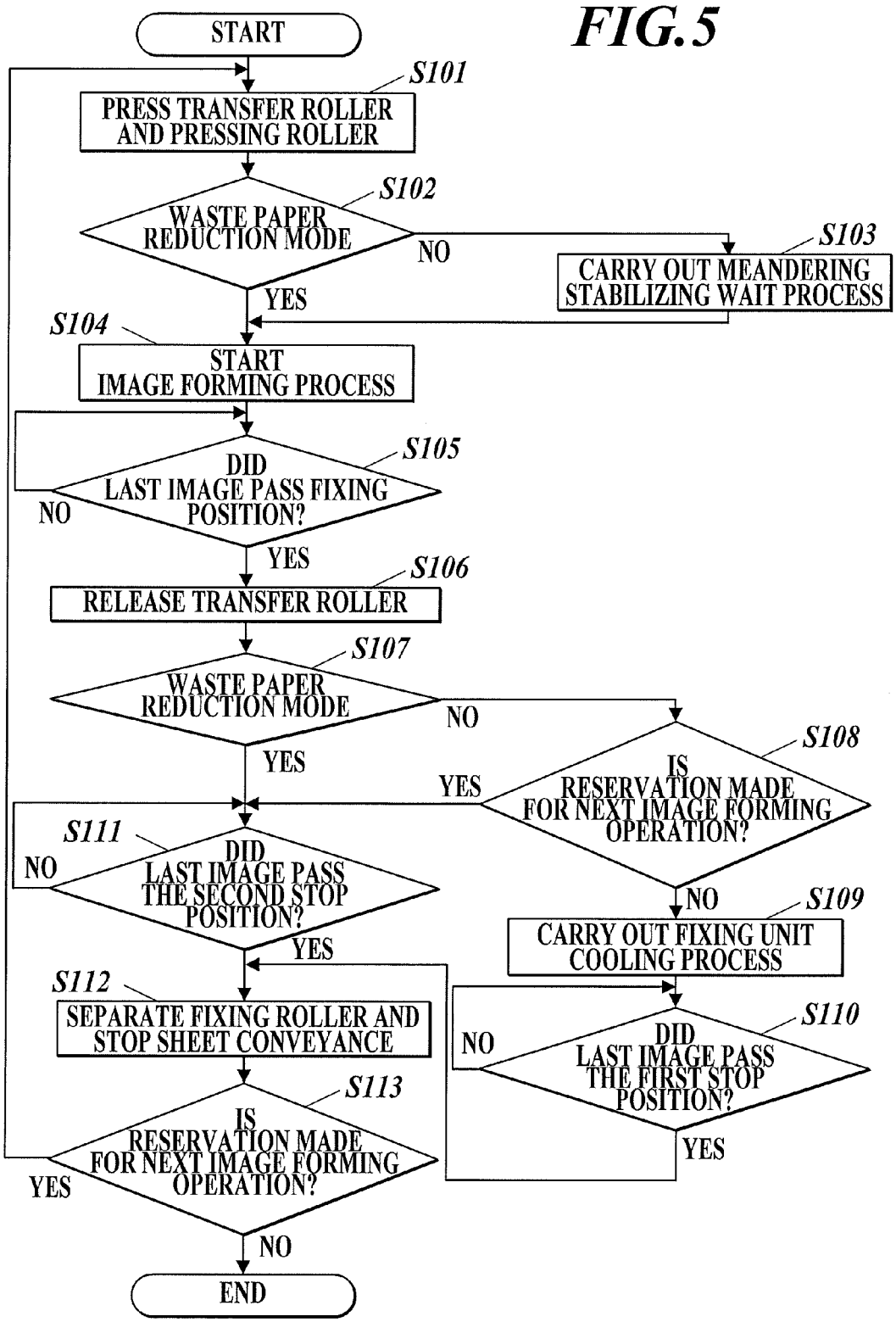
FIG. 5
START
S101
PRESS TRANSFER ROLLER AND PRESSING ROLLER
S102
WASTE PAPER REDUCTION MODE
NO
S103
CARRY OUT MEANDERING STABILIZING WAIT PROCESS
YES
S104
START IMAGE FORMING PROCESS
S105
DID LAST IMAGE PASS FIXING POSITION?
NO
YES
S106
RELEASE TRANSFER ROLLER
S107
WASTE PAPER REDUCTION MODE
NO
YES
S108
IS RESERVATION MADE FOR NEXT IMAGE FORMING OPERATION?
YES
NO
S109
CARRY OUT FIXING UNIT COOLING PROCESS
S110
DID LAST IMAGE PASS THE FIRST STOP POSITION?
NO
YES
S111
DID LAST IMAGE PASS THE SECOND STOP POSITION?
NO
YES
S112
SEPARATE FIXING ROLLER AND STOP SHEET CONVEYANCE
S113
IS RESERVATION MADE FOR NEXT IMAGE FORMING OPERATION?
YES
NO
END

IMAGE FORMING SYSTEM FOR REDUCING WASTE PAPER

BACKGROUND OF THE INVENTION

1. Field of the Invention

The present invention relates to an image forming system.

2. Description of Related Art

Traditionally, as an image forming system using continuous paper such as a roll of paper as a recording medium, there is known an image forming system including an image forming apparatus, a sheet feeding apparatus which feeds the continuous paper to the image forming apparatus and a roll-up apparatus which rolls up the continuous paper conveyed from the image forming apparatus around a supporting shaft and holds the continuous paper in the rolled up state, for example.

In such image forming system, when ending the image forming process, the continuous paper is usually conveyed until the last image on the continuous paper be at the position (roll-up completion position) where the last image is rolled up around the supporting shaft and then the operation is stopped taking the after processes such as processing, delivery and the like in to consideration.

In such image forming system, there are cases where a process where the continuous paper is conveyed for a predetermined distance after the fixing roller is pressed against the continuous paper and the image forming process is started after waiting for the behavior of the continuous paper during the conveyance to stabilize (meandering stabilizing wait process) and a process where the continuous paper is conveyed in the state where the fixing roller is pressed against the continuous paper after the image forming process to cool the fixing unit (fixing unit cooling process) are carried out.

However, for example, in the case where a proof printing (trial printing) before carrying out the actual image forming job is to be carried out or image forming jobs are to be carried out continuously, if the individual processes are simply carried out continuously, the next image forming process is to be carried out after carrying out the meandering stabilizing wait process and the fixing unit cooling process and after conveying the continuous paper so that the last image be at the roll-up completion position. Thus, great amount of waste paper (white parts) is produced and waiting time occurs between images or between jobs.

Further, the continuous paper which is rolled-up needs to be unrolled manually, for example, in order to check the formed image in the case of proof printing, and this can be troublesome to a user.

For example, JP 2008-114564 suggests a technique to control waste paper when performing printing on continuous paper.

JP 2008-114564 discloses a method where printing is carried out intermittently for specified pages and pieces of paper in order to control waste paper which is produced due to various adjustments such as a density adjustment and the like. However, JP 2008-114564 does not disclose anything about reducing waste paper. Further, JP 2008-114564 discloses that the image forming is to be stopped so that the image can be checked through a checking window if a user instructs to stop the image forming, and this can be troublesome to a user since he/she when checking the image.

SUMMARY OF THE INVENTION

In view of the above problems, an object of the present invention is to provide an image forming system which can reduce waste paper and which can easily check the formed image in an image forming process performed on continuous paper.

To achieve the object described above, according to one aspect of the present invention, there is provided an image forming system, including: a sheet conveyance unit which conveys continuous paper; an image forming unit which forms an image on the continuous paper; a fixing unit which fixes the image formed on the continuous paper; and a controller which controls an image forming operation performed by the sheet conveyance unit, the image forming unit and the fixing unit, wherein in a case where a waste paper reduction mode is selected, the controller controls the sheet conveyance unit to stop conveying the continuous paper so that a bottom end of a last image on the continuous paper be at a second stop position on an upper-stream side of a first stop position after the bottom end of the last image passes the fixing unit when ending the image forming operation, and in a case where the waste paper reduction mode is not selected, the controller controls the sheet conveyance unit to stop conveying the continuous paper so that the bottom end of the last image on the continuous paper be at the first stop position after the bottom end of the last image passes the fixing unit when ending the image forming operation.

Preferably, the image forming system further includes an image forming apparatus including the image forming unit and the fixing unit; and a roll-up apparatus which is disposed away from the image forming apparatus and which rolls up the continuous paper around a supporting shaft, the image being formed on the continuous paper by the image forming apparatus, wherein the first stop position is a position where the bottom end of the last image on the continuous paper is rolled up around the supporting shaft of the roll-up apparatus, and the second stop position is a position between the image forming apparatus and the roll-up apparatus.

Preferably, in the image forming system, in the case where the waste paper reduction mode is not selected, the controller carries out a fixing unit cooling process in which the continuous paper is conveyed in a state being in contact with the fixing unit, and in the case where the waste paper reduction mode is selected, the controller does not carry out the fixing unit cooling process.

Preferably, in the image forming system, in the case where the waste paper reduction mode is not selected, the controller carries out a meandering stabilizing wait process in which the continuous paper is conveyed for a predetermine time period by the sheet conveyance unit before starting an image forming by the image forming unit, and in the case where the wastepaper reduction mode is selected, the controller does not carry out the meandering stabilizing wait process.

Preferably, in the image forming system, the fixing unit includes a pair of rollers which press against and separate from each other, and in the case where the wastepaper reduction mode is selected, the controller sets a separation timing of the pair of rollers when ending the image forming operation so as to be earlier than a separation timing in the case where the waste paper reduction mode is not selected.

Preferably, the image forming system further includes a setting unit by which a user sets the waste paper reduction mode in accordance with an image forming operation type.

Preferably, in the image forming system, the image forming operation type includes a proof printing for checking, an one-image printing where a size of an image forming region on the continuous paper is a predetermined length or shorter and a continuous printing where the image forming operation is carried out continuously.

Preferably, in the image forming system, in a case where the waste paper reduction mode is selected for the continuous printing by the setting unit, the controller determines whether a reservation is made for a next image forming operation after the bottom end of the last image on the continuous paper passes the fixing unit, and in a case where the controller determines that the reservation is made for the next image forming operation, the controller carries out the image forming operation before the reserved image forming operation in the waste paper reduction mode.

Preferably, the image forming system further includes a cutting unit which cuts the continuous paper at a position on the upper-stream side of the first stop position and on the down-stream side of the second stop position.

According to another aspect of the present invention, there is provided a computer readable recording medium storing a program which is executed by a controller of an image forming system including a sheet conveyance unit which conveys continuous paper, an image forming unit which forms an image on the continuous paper, a fixing unit which fixes the image formed on the continuous paper, and the controller which controls an image forming operation performed by the sheet conveyance unit, the image forming unit and the fixing unit, the program makes the controller: control the sheet conveyance unit to stop conveying the continuous paper so that a bottom end of a last image on the continuous paper be at a second stop position on an upper-stream side of a first stop position after the bottom end of the last image passes the fixing unit when ending the image forming operation in a case where a waste paper reduction mode is selected, and control the sheet conveyance unit to stop conveying the continuous paper so that the bottom end of the last image on the continuous paper be at the first stop position after the bottom end of the last image passes the fixing unit when ending the image forming operation in a case where the waste paper reduction mode is not selected.

Preferably, in the computer readable recording medium, the image forming system further includes: an image forming apparatus including the image forming unit and the fixing unit; and a roll-up apparatus which is disposed away from the image forming apparatus and which rolls up the continuous paper around a supporting shaft, the image being formed on the continuous paper by the image forming apparatus, wherein the first stop position is a position where the bottom end of the last image on the continuous paper is rolled up around the supporting shaft of the roll-up apparatus, and the second stop position is a position between the image forming apparatus and the roll-up apparatus.

Preferably, in the computer readable recording medium, the program makes the controller: carry out a fixing unit cooling process in which the continuous paper is conveyed in a state being in contact with the fixing unit in the case where the waste paper reduction mode is not selected, and perform so as not to carry out the fixing unit cooling process in the case where the waste paper reduction mode is selected.

Preferably, in the computer readable recording medium, the program makes the controller: carry out a meandering stabilizing wait process in which the continuous paper is conveyed for a predetermine time period by the sheet conveyance unit before starting an image forming by the image forming unit in the case where the waste paper reduction mode is not selected, and perform so as not to carry out the meandering stabilizing wait process in the case where the waste paper reduction mode is selected.

Preferably, in the computer readable recording medium, the fixing unit includes a pair of rollers which press against and separate from each other, and in the case where the waste paper reduction mode is selected, the program makes the controller set a separation timing of the pair of rollers when ending the image forming operation so as to be earlier than the separation timing in the case where the waste paper reduction mode is not selected.

Preferably, in the computer readable recording medium, the image forming system further comprises a setting unit by which a user sets the waste paper reduction mode in accordance with an image forming operation type.

Preferably, in the computer readable recording medium, the image forming operation type includes a proof printing for checking, an one-image printing where a size of an image forming region on the continuous paper is a predetermined length or shorter and a continuous printing where the image forming operation is carried out continuously.

Preferably, in the computer readable recording medium, in a case where the waste paper reduction mode is selected for the continuous printing by the setting unit, the program makes the controller determine whether a reservation is made for a next image forming operation after the bottom end of the last image on the continuous paper passes the fixing unit, and in a case where the controller determines that the reservation is made for the next image forming operation, the program makes the controller carry out the image forming operation before the reserved image forming operation in the waste paper reduction mode.

Preferably, in the computer readable recording medium, the image forming system further comprises a cutting unit which cuts the continuous paper at a position on the upper-stream side of the first stop position and on the down-stream side of the second stop position.

BRIEF DESCRIPTION OF THE DRAWINGS

The above and other objects, advantages are features of the present invention will become more fully understood from the detailed description given hereinbelow and the appended drawings which are given by way of illustration only, and thus are not intended as a definition of the limits of the present invention, and wherein:

FIG. 5 is a flowchart showing a procedure of an image forming operation;

DESCRIPTION OF THE PREFERRED EMBODIMENTS

Figure 1:
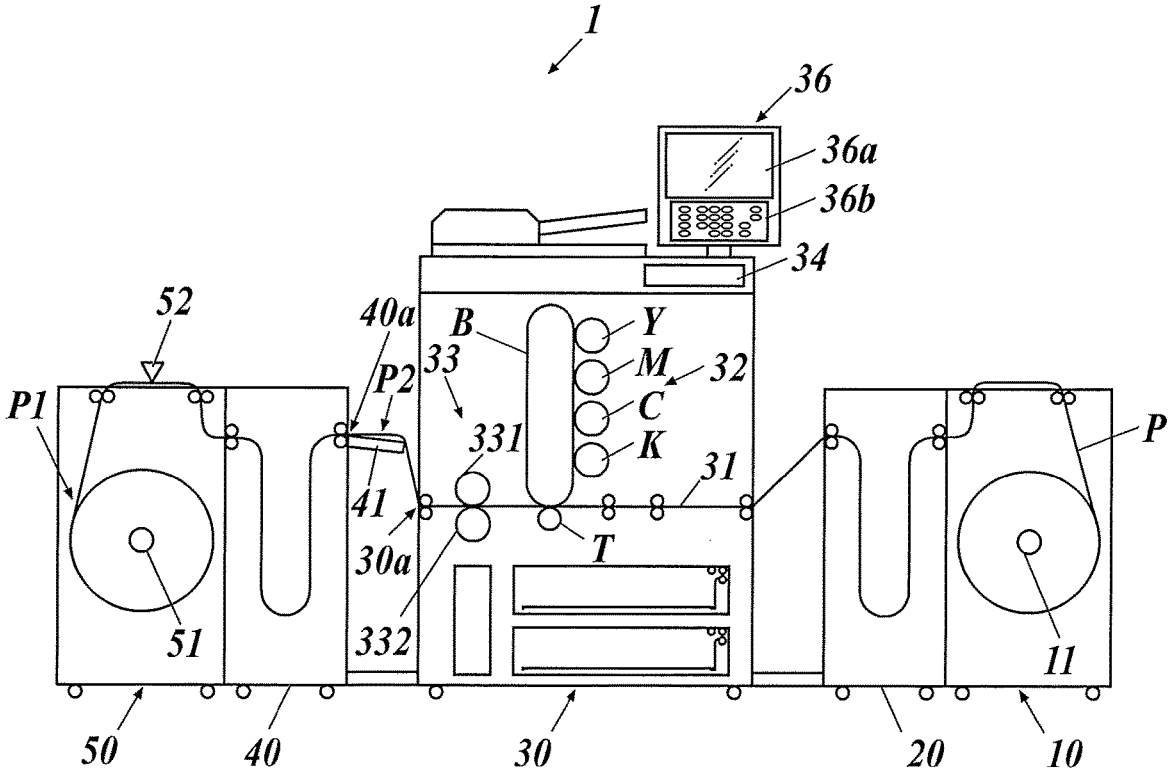
FIG. 1 shows an example of an outline structure of an image forming system according to the present invention.

Hereinafter, an embodiment of the present invention will be described with reference to the drawings. However, the scope of the invention is not limited to the examples shown in the drawings.

First, the structure of the image forming system according to the embodiment will be described.

FIG. 1 shows an example of an outline structure of the image forming system 1.

The image forming system 1 is a system which uses continuous paper (a roll of paper) P as a recording medium and which forms images on the continuous paper P.

As shown in FIG. 1, the image forming system 1 is formed by a sheet feeding apparatus 10, an image forming apparatus 30 and a roll-up apparatus 50 being connected in this order from the upper-stream side along the conveyance direction of the continuous paper P.

The sheet feeding apparatus 10 is an apparatus which includes a sheet feeding adjuster 20 and which feeds the continuous paper P to the image forming apparatus 30 via the sheet feeding adjuster 20. As shown in FIG. 1, the continuous paper P in a rolled up state is held inside the housing case of the sheet feeding apparatus 10, the continuous paper P being rolled up around a supporting shaft 11 so as to rotate, for example. In the sheet feeding apparatus 10, the continuous paper P which is rolled up around the supporting shaft 11 is conveyed to the sheet feeding adjuster 20 at a set speed via a plurality of rollers. Here, there is no need to hold the continuous paper P in the rolled up state in the sheet feeding apparatus 10 and the continuous paper P may be held in a folded state. Although only one continuous paper P is shown in FIG. 1, a plurality of rolls of continuous paper may be held.

The sheet feeding adjuster 20 is a mechanism for conveying the continuous paper P which is conveyed from the supporting shaft 11 to the image forming apparatus 30. In order to absorb the difference between the convey speed of the continuous paper P in the sheet feeding apparatus 10 and the convey speed of the continuous paper P in the image forming apparatus 30, the sheet feeding adjuster 20 holds the continuous paper P so that the continuous paper P sags as shown in FIG. 1 to adjust the feeding of the continuous paper P to the image forming apparatus 30.

The image forming apparatus 30 is an apparatus having a function to form an image on the continuous paper P. The image forming apparatus 30 is disposed on the down-stream side of the sheet feeding apparatus 10 and on the upper-stream side of the roll-up apparatus 50 in the conveyance direction of the continuous paper P.

The roll-up apparatus 50 is an apparatus which includes a roll-up adjuster 40 and which rolls up the continuous paper P which is conveyed from the image forming apparatus 30 via the roll-up adjuster 40.

The roll-up adjuster 40 is a mechanism for conveying the continuous paper P which is conveyed from the image forming apparatus 30 to the roll-up apparatus 50. In order to absorb the difference between the convey speed of the continuous paper P in the image forming apparatus 30 and the convey speed of the continuous paper P in the roll-up apparatus 50, the roll-up adjuster 40 holds the continuous paper P so that the continuous paper P sags as shown in FIG. 1 to adjust output of the continuous paper P from the image forming apparatus 30.

As shown in FIG. 1, the continuous paper P is held inside the housing case of the roll-up apparatus 50 in the rolled up state, for example. In particular, in the roll-up apparatus 50, the continuous paper P which is conveyed from the roll-up adjuster 40 is rolled up around the supporting shaft 51 at a set speed while passing through the conveyance path which makes the continuous paper P be exposed on the upper surface of the apparatus and then bring the continuous paper P back inside the apparatus again via a plurality of rollers.

A cutter 52 is provided in the conveyance path of the continuous paper P on the upper surface of the roll-up apparatus 50. The cutter 52 includes a long cutting blade along the width of the continuous paper P, the cutting blade being movable in the up and down directions, and the cutter 52 cuts the continuous paper P at a predetermined position.

The roll-up apparatus 50 is disposed so as to have a predetermined distance from the image forming apparatus 30. Thus, the continuous paper P is output from the carry out exit 30*a* of the image forming apparatus 30 to be exposed and then, is conveyed in the state where the lower surface of the continuous paper P being supported by the supporting board 41 of the roll-up adjuster 40 to be conveyed inside the roll-up adjuster 40 again from the carry in entrance 40*a* of the roll-up adjuster 40.

Next, the structure of the image forming apparatus 30 will be described in detail.

Figure 2:
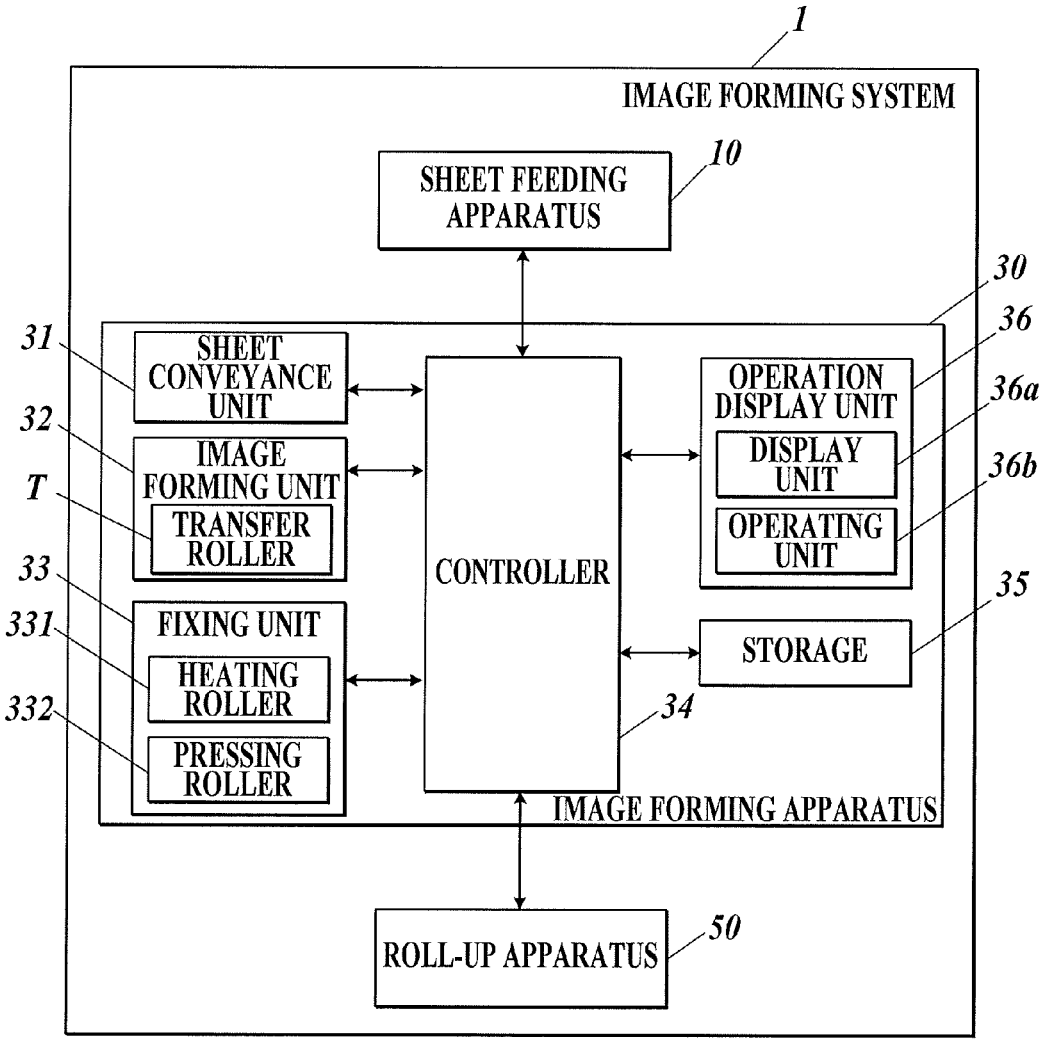
FIG. 2 is a functional block diagram showing a controlling structure of the image forming system according to the present invention.

FIG. 2 is a functional block diagram showing a controlling structure of the image forming apparatus 30.

As shown in FIG. 2, the image forming apparatus 30 includes a sheet conveyance unit 31, an image forming unit 32, a fixing unit 33, a controller 34, a storage 35 and an operation display unit 36, for example.

The sheet conveyance unit 31 is a conveyance mechanism of the continuous paper P which is provided inside the image forming apparatus 30. For example, the sheet conveyance unit 31 conveys the continuous paper P which is conveyed from the sheet feeding adjuster 20 to the image forming unit 32 and conveys the continuous paper P which passed the image forming unit 32 and the fixing unit 33 to the roll-up adjuster 40 by a plurality of rollers.

The image forming unit 32 forms a toner image by the electrophotographic process and transfers the toner image on to the continuous paper P.

For example, in the image forming unit 32, photoconductor drums (Y, M, C, K) and an intermediate transfer belt B are used as image carriers (see FIG. 1). The intermediate transfer belt B is an endless belt which is wound around the plurality of rollers and made to rotate by the plurality of rollers. Toner images of individual colors which are formed on the photoconductor drums (Y, M, C, K) are sequentially transferred on to the intermediate transfer belt B and a toner image (color image) in which layers of individual colors (Y, M, C, K) are superimposed on each other is formed on the intermediate transfer belt B. By applying a bias having the reverse polarity of toner to the transfer roller T, the toner image formed on the intermediate transfer belt B is transferred on to the continuous paper P. The transfer roller T presses against or separates from the intermediate transfer belt B at a predetermined timing in accordance with the controlling of the controller 34.

The fixing unit 33 fixes the toner image which is transferred on the continuous paper P.

For example, the fixing unit 33 includes a pair of rollers, which are the heating roller 331 and the pressing roller 332, for holding the continuous paper P therebetween.

The heating roller 331 is heated to a predetermined temperature by a heater as a heating source.

The pressing roller 332 presses against or separates from the heating roller 331 at a predetermined timing in accordance with the controlling of the controller 34.

By the continuous paper P on which the toner image is transferred passing through the nip unit formed by the heating roller 331 and the pressing roller 332, heat and pressure is applied to the continuous paper P and the toner image melts to be fixed on to the continuous paper P.

A temperature sensor is disposed at a position near the outer circumference of the pressing roller 332. The temperature sensor can measure the temperature of the area near the outer circumference of the pressing roller 332 as the temperature of the fixing unit 33.

The controller 34 is formed by a CPU (Central Processing Unit), a RAM (Random Access Memory) and the like, for example. The CPU of the controller 34 reads out various types of programs such as a system program, a process program and the like which are stored in the storage 35, opens them in the RAM and executes various types of processes in accordance with the opened programs.

For example, the controller 34 controls the individual units included in the image forming apparatus 30 and executes the image forming operation where an image is formed on the continuous paper P while the continuous paper P being conveyed according to a predetermined conveyance mode ("normal mode" or "waste paper reduction mode").

The "normal mode" is the default mode.

In particular, if the conveyance mode of the continuous paper P is set to the "normal mode", the controller 34 carries out a meandering stabilizing wait process and a fixing unit cooling process (details will be described later). In this mode, when the image forming operation is to end, the controller 34 conveys the continuous paper P to the roll-up completion position (the first stop position, P1 in FIG. 1) where the last image on the continuous paper P is rolled up by the supporting shaft 51 and stops the conveyance of the continuous paper P.

The "waste paper reduction mode" is a mode for reducing white parts (waste paper) which are produced in the "normal mode".

In particular, in the case where the conveyance mode of the continuous paper P is set to the "waste paper reduction mode", the controller 34 does not execute the meandering stabilizing wait process and the fixing unit cooling process. In this mode, when ending the image forming operation, the controller 34 conveys the continuous paper P until the last image on the continuous paper P be between the image forming apparatus 30 and the roll-up adjuster 40, that is, so that the last image is visible (the second stop position, P2 in FIG. 1) and stops conveying the continuous paper P.

The meandering stabilizing wait process is a process where the continuous paper P is conveyed for a predetermined distance (for example, about 4 m) after making the heating roller 311 and the pressing roller 332 of the fixing unit 33 be pressed against each other to stabilize the behavior of the continuous paper P. If the meandering stabilizing wait process is carried out, the image forming process is to be started after the behavior of the continuous paper P is stabilized.

The fixing unit cooling process is a process where, after the image forming process is carried out, the heating roller 331 and the pressing roller 332 of the fixing unit 33 are made to separate and made to press against each other again and then, the continuous paper P is conveyed for a predetermined distance. If the fixing unit cooling process is carried out, the heat of the fixing unit 33 is absorbed by the continuous paper P being conveyed and the fixing unit 33 can be cooled efficiently.

The "waste paper reduction mode" is preferably used in the case where the image forming operation type is the continuous printing, proof printing, one-image printing or the like, for example.

The "continuous printing" is the image forming operation where a plurality of jobs are carried out continuously.

The "proof printing" is the image forming operation carried out before the actual image forming so that a user can check the image which is to be formed on the continuous paper P.

The "one-image printing" is the image forming operation where the size of the image forming region on the continuous paper P is a predetermined length or shorter.

That is, since a plurality of jobs are carried out continuously in the "continuous printing", it is more efficient that waste paper parts are not produced between the jobs. Since the "proof printing" is for a user to check the image formed on the continuous paper P, it is preferred that the conveyance of the continuous paper P is stopped at the position where the last image on the continuous paper P can be checked. Since the size of the image forming region is small in the "one-image printing", waste paper parts are produced more than usual and it is more efficient to carry out this printing in the waste paper reduction mode.

The storage 35 is formed by a HDD (Hard Disk Drive), a semiconductor non-volatile memory or the like, for example.

In the storage 35, various types of programs such as a system program and process programs which are to be executed by the controller 34 and data necessary for executing the programs are stored.

For example, setting information necessary for executing the image forming operation is stored in the storage 35. In particular, in the storage 35, conveyance modes of the continuous paper P in the image forming operation which a user sets by operating on the setting screen (after-mentioned) of the operation display unit 36 and the like are stored.

The operation display unit 36 includes a display screen as the setting unit, and includes the display unit 36*a* which displays various information on the screen and the operating unit 36*b* which is used by a user to input various instructions.

The operation display unit 36 is used as the setting unit when the setting of the conveyance mode of the continuous paper P in the image forming operation is to be changed, for example.

Figure 3:
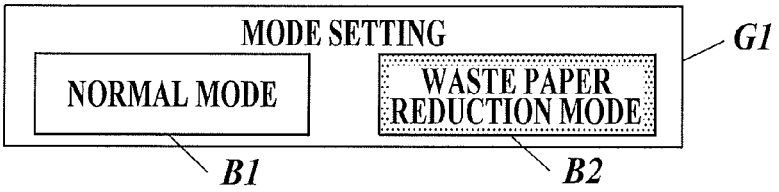
FIG. 3 shows an example of a setting table.

FIG. 3 shows an example of a setting screen which is displayed in the display unit 36*a* of the operation display unit 36. This screen is the setting screen G1 which is used in the case where the setting of the conveyance mode of the continuous paper P is to be changed.

In the setting screen G1, the button B1 which specifies the "normal mode" and the button B2 which specifies the "waste paper reduction mode" are displayed.

Setting of the conveyance mode of the continuous paper P may be changed in accordance with the image forming operation type.

Figure 4:
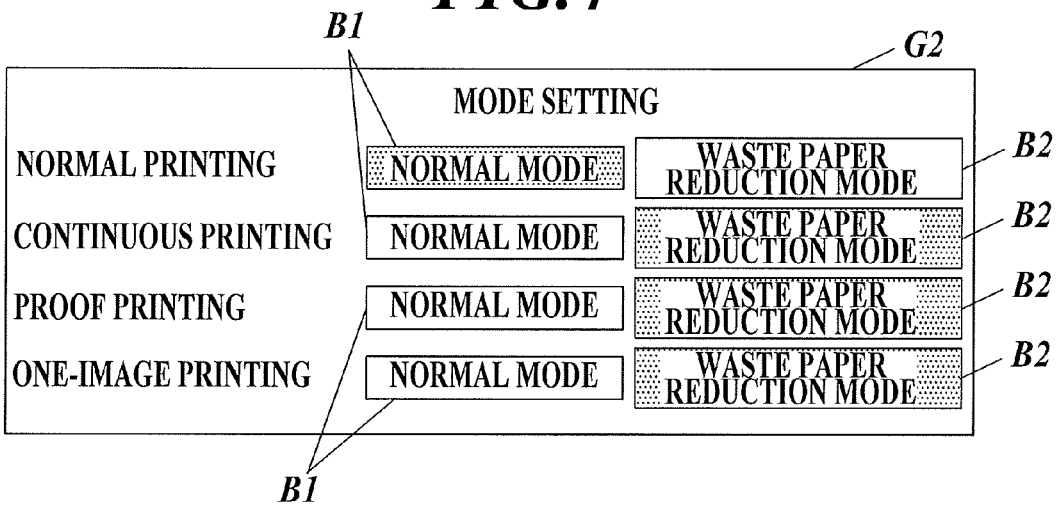
FIG. 4 shows another example of a setting table.

FIG. 4 is an example of the setting screen G2 which is used in the case where the setting of the conveyance mode of the continuous paper P is to be changed in accordance with the image forming operation type. In the setting screen G2, items representing four types of image forming which are the "normal printing", "continuous printing", "proof printing" and "one-image printing" are displayed. In the setting screen G2, with respect to each item representing an image forming operation, the button B1 which specifies the "normal mode" and the button B2 which specifies the "waste paper reduction mode" are displayed.

A user performs a selecting operation on the button B1 or the button B2 in the setting screen G1 or in the setting screen G2 to change the setting of the conveyance mode of the continuous paper P.

With respect to the conveyance mode of the continuous paper P, the "normal mode" is set as default, the "normal mode" will be set if a user does not perform the setting change operation.

In the embodiment, although the controller 34 integrally controls the entire image forming system 1 as shown in FIG. 2, each apparatus such as the sheet feeding apparatus 10 and the roll-up apparatus 50 may have its own controller.

The image forming apparatus 30 may be a MFP (Multi-Function Peripheral) having a copying function, a scanning function a facsimile function and the like in addition to the image forming function.

Next, the operation of the image forming system 1 according to the embodiment will be described.

Figure 6:
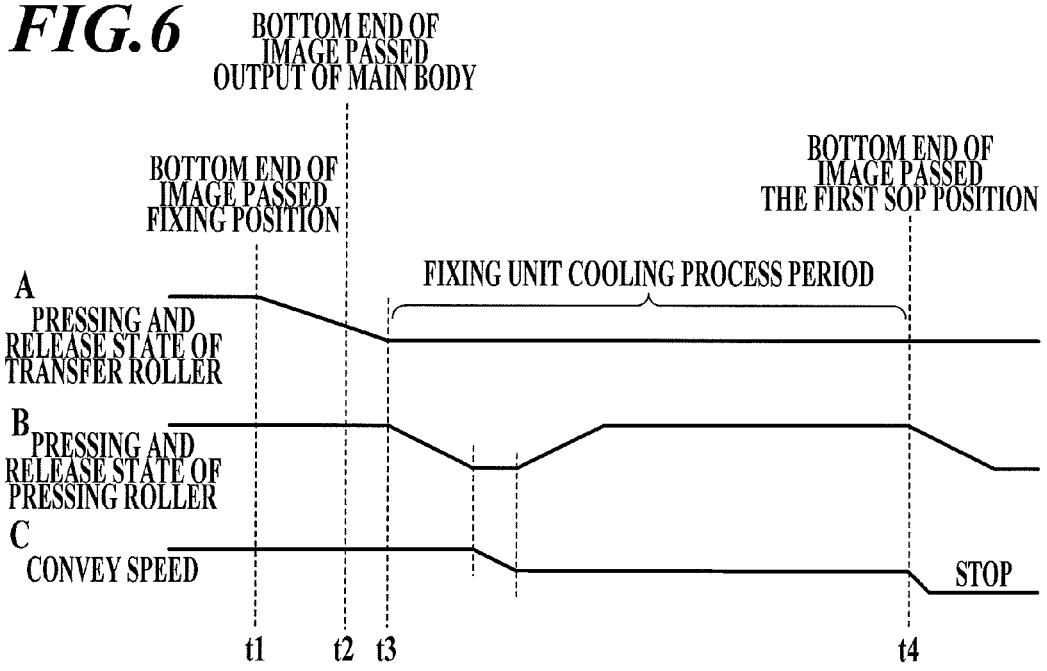
FIG. 6 shows a stop sequence in a normal mode.

FIG. 5 is a flowchart showing the procedure of the image forming operation which is carried out in the image forming system 1. FIG. 6 shows the stop sequence in the normal mode and FIG. 7 shows the stop sequence in the waste paper reduction mode.

Figure 7:
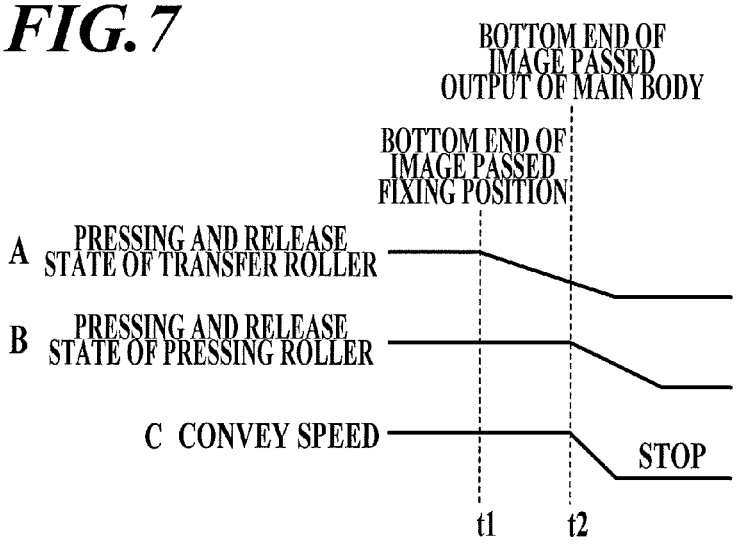
FIG. 7 shows a stop sequence in a waste paper reduction mode.

In FIGS. 6 and 7, with respect to (A) and (B), the vertical axes express the moving distance of the transfer roller T of the image forming unit 32 and the moving distance of the pressing roller 332 of the fixing unit 33 and the horizontal axes express the time. With respect to (C), the vertical axis expresses the convey speed of the continuous paper P and the horizontal axis expresses the time.

As premises for the image forming operation, the conveyance mode of the continuous paper P is set in advance.

First, the controller 34 makes the transfer roller T of the image forming unit 32 and the pressing roller 332 of the fixing unit 33 be pressed (step S101).

Next, the controller 34 determines whether the "waste paper reduction mode" is set as the conveyance mode of the continuous paper P (step S102). If the controller 34 determines that the "waste paper reduction mode" is not set (step S102: NO), the controller 34 carries out the meandering stabilizing wait process (step S103) and proceeds to the after-mentioned step S104.

If the controller 34 determines that the "waste paper reduction mode" is set (step S102: YES), the controller 34 starts the image forming process (step S104).

Next, the controller 34 determines whether the last image on the continuous paper P passed the fixing unit 33 (step S105). If the controller 34 determines that the last image on the continuous paper P has not passed the fixing unit 33 (step S105: NO), the controller 34 repeats step S105.

If the controller 34 determines that the last image on the continuous paper P passed the fixing unit 33 (step S105: YES), the controller 34 starts to release the pressing of the transfer roller T (t1 in FIGS. 6 and 7) (step S106).

Next, the controller 34 determines whether the "waste paper reduction mode" is set (step S107). If the controller 34 determines that the "waste paper reduction mode" is not set (step S107: NO), the controller 34 determines whether a reservation is made for the next image forming operation (step S108).

If the controller 34 determines that the reservation is made for the next image forming operation (step S108: YES), the controller 34 proceeds to the after-mentioned step S111.

If the controller 34 determines that the reservation is not made for the next image forming operation (step S108: NO), the controller 34 carries out the fixing unit cooling process (t3 to t4 in FIG. 6) (step S109). Thereafter, the controller 34 determines whether the last image passed the first stopping position (step S110).

If the controller 34 determines that the last image has not passed the first stop position (step S110: NO), the controller 34 repeats the determination of step S110. If the controller 34 determines that the last image has passed the first stop position (t4 in FIG. 6) (step S110: YES), the controller 34 proceeds to the after-mentioned step S112.

In step S107, if the controller 34 determines that the "waste paper reduction mode" is set (step S107: YES), the controller 34 determines whether the last image passed the second stop position (step S111).

If the controller 34 determines that the last image has not passed the second stop position (step S111: NO), the controller 34 repeats the determination of step S111.

If the controller 34 determines that the last image has passed the second stop position (t2 in FIG. 7) (step S111: YES), the controller 34 proceeds to the after-mentioned step S112.

Next, the controller 34 starts to release pressing of the pressing roller 332 of the fixing unit 33 (t4 in FIG. 6, t2 in FIG. 7) and stops the sheet conveyance (step S112).

Next, the controller 34 determines whether a reservation is made for the next image forming operation (step S113). If the controller 34 determines that the reservation is made for the next image forming operation (step S113: YES), the controller 34 returns to step S101 and repeats the process thereafter.

If the controller 34 determines that the reservation is not made for the next image forming operation (step S113: NO), the controller 34 ends the process.

As shown in FIG. 6, in the case where the normal mode is set, the meandering stabilizing wait process and the fixing unit cooling process are carried out. On the other hand, these processes are not carried out in the waste paper reduction mode as shown in FIG. 7. Thus, in the case where the waste paper reduction mode is set, the process where a blank part (blank page) of the continuous paper P is to be conveyed is omitted.

As shown in FIG. 6, in the case where the normal mode is set, the pressing roller 332 starts to separate after the transfer roller T is completely separated. On the other hand, in the case where the waste paper reduction mode is set, the pressing roller 332 starts to separate at the timing when the last image passes the carry out exit 30*a* of the image forming apparatus 30 regardless of the condition of the transfer roller T, as shown in FIG. 7. Thus, the conveyance is stopped in the state where the last image on the continuous paper is at the second stop position where the image can be visually recognized.

As described above, according to the embodiment, the present invention includes the sheet conveyance unit 31 which conveys the continuous paper P, the image forming unit 32 which forms an image on the continuous paper P, the fixing unit 33 which fixes an image formed on the continuous paper P, and the controller 34 which controls the image forming operation performed by the sheet conveyance unit 31, the image forming unit 32 and the fixing unit 33. In the case where the waste paper reduction mode is selected, the controller 34 controls the sheet conveyance unit 31 to make the bottom edge of the last image on the continuous paper P pass the fixing unit 33 and then, the controller 34 stops conveying the continuous paper P so that the bottom edge of the last image be at the second stop position on the upper-stream side of the first stop position when ending the image forming operation. In the case where the waste paper reduction mode is not selected, the controller 34 controls the sheet conveyance unit 31 to make the bottom edge of the last image on the continuous paper P pass the fixing unit 33 and then, the controller 34 stops conveying the continuous paper P so that the bottom edge of the last image be at the first stop position when ending the image forming operation.

Thus, since the conveyance is stopped so that the bottom edge of the last image be at the second stop position on the upper-stream side than usual in the waste paper reduction mode, waste paper can be reduced and the formed images can be checked easily.

Further, according to the embodiment, the present invention includes the image forming apparatus 30 including the image forming unit 32 and the fixing unit 33, and the roll-up apparatus 50 which is disposed away from the image forming apparatus 30 and which rolls up the continuous paper P on which images are formed by the image forming apparatus 30 around the supporting shaft 51. The first stop position is the position where the bottom edge of the last image on the continuous paper P is rolled up around the supporting shaft 51 of the roll-up apparatus 50. The second stop position is a position between the image forming apparatus 30 and the roll-up apparatus 50.

Thus, in the normal mode, the continuous paper P can be conveyed to and stop at the first stop position that has a beneficial effect in the process thereafter. Further, in the waste paper reduction mode, the continuous paper P is stopped right after the image forming so that waste paper is reduced and the formed image can be checked easily.

Furthermore, according to the embodiment, in the case where the waste paper reduction mode is not selected, the controller 34 carries out the fixing unit cooling process where the continuous paper P is conveyed while being in contact with the fixing unit 33. In the case where the waste paper reduction mode is selected, the fixing unit cooling process is not carried out.

Thus, in the waste paper reduction mode, waste paper can be reduced since the conveyance time of the blank part (blank page) of the continuous paper P during the fixing unit cooling process can be omitted.

Moreover, according to the embodiment, in the case where the waste paper reduction mode is not selected, the controller 34 carries out the meandering stabilizing wait process where the continuous paper P is conveyed for a predetermined time period by the sheet conveyance unit 31 before starting the image forming by the image forming unit 32. In the case where the waste paper reduction mode is selected, the meandering stabilizing wait process is not carried out.

Thus, in the waste paper reduction mode, waste paper can be reduced since the conveyance time of the blank part (blank page) of the continuous paper P before starting of the image forming can be omitted.

Further, according to the embodiment, the fixing unit 33 includes a pair of rollers which can be pressed against each other and separated from each other. In the case where the waste paper reduction mode is selected, the controller 34 sets the separation timing of the pair of rollers when ending the image forming operation be earlier comparing to the case where the waste paper reduction mode is not selected.

Thus, in the waste paper reduction mode, controlling where conveyance of the continuous paper P is stopped right after the continuous paper P passes the fixing unit 33 can be realized.

Furthermore, according to the embodiment, the present invention includes the operation display unit 36 by which a user can set the waste paper reduction mode in accordance with the image forming operation type.

Thus, the waste paper reduction mode can be set in accordance with the image forming operation type freely by a user.

Moreover, according to the embodiment, there are four types of image forming operation which are the proof printing for checking, the one-image printing where the size of the image forming region on the continuous paper 1) is a predetermined length or shorter and the continuous printing where the image forming operation is carried out continuously.

Thus, in the proof printing, one-image printing and continuous printing, the wastepaper reduction mode can be set.

Further, according to the embodiment, in the case where the waste paper reduction mode is set for the continuous printing by the operation display unit 36, the controller 34 determines whether a reservation is made for the next image forming operation after the bottom edge of the last image on the continuous paper P passes the fixing unit 33. If the controller 34 determines that the reservation is made for the next image forming operation, the image forming operation before this reserved image forming operation is to be carried out in the waste paper reduction mode.

Thus, in the case where image forming operation is carried out continuously, waste paper can be reduced. For example, even in the case where the reservation is made for the next image forming operation while the image forming operation of the normal mode is being carried out, the image forming operation which is being carried out (the image forming operation before the reserved image forming operation) can be carried out in the waste paper reduction mode.

Furthermore, according to the embodiment, the cutting unit 52 which cuts the continuous paper P is provided on the upper-stream side of the first stop position and on the down-stream side of the second stop position.

Thus, the continuous paper P can be cut at the predetermined position.

In the embodiment, an example where a user can change the mode setting in accordance with the image forming operation type is described. However, in the case where the image forming operation type is the proof printing, one-image printing or continuous printing, for example, the controller 34 may automatically select the waste paper reduction mode.

The entire disclosure of Japanese Patent Application No. 2015-172438 filed on Sep. 2, 2015 is incorporated herein by reference in its entirety.

What is claimed is:

1. An image forming system, comprising:

a sheet conveyance unit which conveys continuous paper;

an image forming unit which forms an image on the continuous paper;

a fixing unit which fixes the image formed on the continuous paper; and a controller which controls an image forming operation performed by the sheet conveyance unit, the image forming unit and the fixing unit, wherein in a case where a waste paper reduction mode is selected, the controller controls the sheet conveyance unit to stop conveying the continuous paper so that a bottom end of a last image on the continuous paper be at a second stop position on an upper-stream side of a first stop position, without backtracking, after the bottom end of the last image passes the fixing unit when ending the image forming operation, and in a case where the waste paper reduction mode is not selected, the controller controls the sheet conveyance unit to stop conveying the continuous paper so that the bottom end of the last image on the continuous paper be at the first stop position after the bottom end of the last image passes the fixing unit when ending the image forming operation.

2. The image forming system of claim 1, further comprising:

an image forming apparatus including the image forming unit and the fixing unit; and a roll-up apparatus which is disposed away from the image forming apparatus and which rolls up the continuous paper around a supporting shaft, the image being formed on the continuous paper by the image forming apparatus, wherein the first stop position is a position where the bottom end of the last image on the continuous paper is rolled up around the supporting shaft of the roll-up apparatus, and the second stop position is a position between the image forming apparatus and the roll-up apparatus.

3. The image forming system of claim 1, wherein in the case where the waste paper reduction mode is not selected, the controller carries out a fixing unit cooling process in which the continuous paper is conveyed in a state being in contact with the fixing unit, and in the case where the waste paper reduction mode is selected, the controller does not carry out the fixing unit cooling process.

4. The image forming system of claim 1, wherein in the case where the waste paper reduction mode is not selected, the controller carries out a meandering stabilizing wait process in which the continuous paper is conveyed for a predetermine time period by the sheet conveyance unit before starting an image forming by the image forming unit, and in the case where the waste paper reduction mode is selected, the controller does not carry out the meandering stabilizing wait process.

5. The image forming system of claim 1, wherein the fixing unit includes a pair of rollers which press against and separate from each other, and in the case where the waste paper reduction mode is selected, the controller sets a separation timing of the pair of rollers when ending the image forming operation so as to be earlier than a separation timing in the case where the waste paper reduction mode is not selected.

6. The image forming system of claim 1, further comprising a setting unit by which a user sets the waste paper reduction mode in accordance with an image forming operation type.

7. The image forming system of claim 6, wherein the image forming operation type includes a proof printing for checking, an one-image printing where a size of an image forming region on the continuous paper is a predetermined length or shorter and a continuous printing where the image forming operation is carried out continuously.

8. The image forming system of claim 7, wherein in a case where the waste paper reduction mode is selected for the continuous printing by the setting unit, the controller determines whether a reservation is made for a next image forming operation after the bottom end of the last image on the continuous paper passes the fixing unit, and in a case where the controller determines that the reservation is made for the next image forming operation, the controller carries out the image forming operation before the reserved image forming operation in the waste paper reduction mode.

9. The image forming system of claim 1, further comprising a cutting unit which cuts the continuous paper at a position on the upper-stream side of the first stop position and on the down-stream side of the second stop position.

10. A computer readable recording medium storing a program which is executed by a controller of an image forming system comprising a sheet conveyance unit which conveys continuous paper, an image forming unit which forms an image on the continuous paper, a fixing unit which fixes the image formed on the continuous paper, and the controller which controls an image forming operation performed by the sheet conveyance unit, the image forming unit and the fixing unit, the program makes the controller:

control the sheet conveyance unit to stop conveying the continuous paper so that a bottom end of a last image on the continuous paper be at a second stop position on an upper-stream side of a first stop position, without backtracking, after the bottom end of the last image passes the fixing unit when ending the image forming operation in a case where a waste paper reduction mode is selected, and control the sheet conveyance unit to stop conveying the continuous paper so that the bottom end of the last image on the continuous paper be at the first stop position after the bottom end of the last image passes the fixing unit when ending the image forming operation in a case where the waste paper reduction mode is not selected.

11. The computer readable recording medium of claim 10, wherein the image forming system further comprises:

an image forming apparatus including the image forming unit and the fixing unit; and a roll-up apparatus which is disposed away from the image forming apparatus and which rolls up the continuous paper around a supporting shaft, the image being formed on the continuous paper by the image forming apparatus, wherein the first stop position is a position where the bottom end of the last image on the continuous paper is rolled up around the supporting shaft of the roll-up apparatus, and the second stop position is a position between the image forming apparatus and the roll-up apparatus.

12. The computer readable recording medium of claim 10, wherein the program makes the controller:

carry out a fixing unit cooling process in which the continuous paper is conveyed in a state being in contact with the fixing unit in the case where the waste paper reduction mode is not selected, and perform so as not to carry out the fixing unit cooling process in the case where the waste paper reduction mode is selected.

13. The computer readable recording medium of claim 10, wherein the program makes the controller:

carryout a meandering stabilizing wait process in which the continuous paper is conveyed for a predetermine time period by the sheet conveyance unit before starting an image forming by the image forming unit in the case where the waste paper reduction mode is not selected, and perform so as not to carryout the meandering stabilizing wait process in the case where the waste paper reduction mode is selected.

14. The computer readable recording medium of claim 10, wherein the fixing unit includes a pair of rollers which press against and separate from each other, and in the case where the waste paper reduction mode is selected, the program makes the controller set a separation timing of the pair of rollers when ending the image forming operation so as to be earlier than the separation timing in the case where the waste paper reduction mode is not selected.

15. The computer readable recording medium of claim 10, wherein the image forming system further comprises a setting unit by which a user sets the waste paper reduction mode in accordance with an image forming operation type.

16. The computer readable recording medium of claim 15, wherein the image forming operation type includes a proof printing for checking, an one-image printing where a size of an image forming region on the continuous paper is a predetermined length or shorter and a continuous printing where the image forming operation is carried out continuously.

17. The computer readable recording medium of claim 16, wherein in a case where the waste paper reduction mode is selected for the continuous printing by the setting unit, the program makes the controller determine whether a reservation is made for a next image forming operation after the bottom end of the last image on the continuous paper passes the fixing unit, and in a case where the controller determines that the reservation is made for the next image forming operation, the program makes the controller carry out the image forming operation before the reserved image forming operation in the waste paper reduction mode.

18. The computer readable recording medium of claim 10, wherein the image forming system further comprises a cutting unit which cuts the continuous paper at a position on the upper-stream side of the first stop position and on the down-stream side of the second stop position.

* * * * *